US011642583B1

(12) United States Patent
Stroffolino

(10) Patent No.: US 11,642,583 B1
(45) Date of Patent: May 9, 2023

(54) PUTTING ALIGNMENT SYSTEM

(71) Applicant: Joe Stroffolino, Mckinney, TX (US)

(72) Inventor: Joe Stroffolino, Mckinney, TX (US)

( * ) Notice: Subject to any disclaimer, the term of this patent is extended or adjusted under 35 U.S.C. 154(b) by 0 days.

(21) Appl. No.: 17/550,319

(22) Filed: Dec. 14, 2021

(51) Int. Cl.
*A63B 69/36* (2006.01)
*A63B 71/06* (2006.01)

(52) U.S. Cl.
CPC ..... *A63B 69/3614* (2013.01); *A63B 71/0622* (2013.01); *A63B 2071/0625* (2013.01); *A63B 2071/0694* (2013.01); *A63B 2220/05* (2013.01); *A63B 2220/807* (2013.01); *A63B 2225/50* (2013.01)

(58) Field of Classification Search
CPC ..... A63B 69/3614; A63B 71/0622; A63B 2071/0625; A63B 2071/0694; A63B 2220/05; A63B 2220/807; A63B 2225/50
USPC ..... 473/131, 150–156, 219–255
See application file for complete search history.

(56) References Cited

U.S. PATENT DOCUMENTS 5,114,150 A * 5/1992 Matsumura ..... G01P 3/66 473/222
5,257,084 A * 10/1993 Marsh ..... G01P 3/68 356/28
5,692,966 A * 12/1997 Wash ..... A63B 69/3614 473/409
6,095,928 A * 8/2000 Goszyk ..... A63B 69/3614 345/158
6,887,162 B2 * 5/2005 Lindsay ..... G01P 3/68 473/151
7,499,828 B2 * 3/2009 Barton ..... A63B 24/0003 473/220
2005/0215335 A1 * 9/2005 Marquardt ..... A63B 69/3685 473/131
2008/0200274 A1 * 8/2008 Haag ..... G01S 17/04 473/222

* cited by examiner

*Primary Examiner* — Nini F Legesse
(74) *Attorney, Agent, or Firm* — Clement Cheng

(57) ABSTRACT

A putting alignment system includes a lateral imaging alignment guide having a set of indicia, including an upper indicia, a lower indicia, a right indicia, and a left indicia. The lateral imaging alignment guide has a generally flat body that is configured to removably connect to a golf club shaft. A club lower distal tip reflector is configured for mounting on a distal tip of a golf club. A lateral imaging apparatus includes an imaging system. The imaging system has a main camera. The main camera captures and records motion of the lateral imaging alignment guide. A secondary alignment system includes a forward receiver sensor. The forward receiver sensor detects orientation of the club lower distal tip reflector when the club lower distal tip reflector is facing the forward receiver sensor.

20 Claims, 4 Drawing Sheets

PUTTING ALIGNMENT SYSTEM

FIELD OF THE INVENTION

The present invention is in the field of putting alignment systems.

DISCUSSION OF RELATED ART

A variety of different putting trainers have improved golf swing training over the years. For example, in U.S. Pat. No. 7,499,828, issued Mar. 3, 2009 to inventor Mario Barton, the disclosure of which is incorporated herein by reference, the relative displacement of a rigid object with three data sources can have predefined movement parameters based on the position of each data source on the object. A receiver unit can display positional information.

Golf swing trainer technologies measure principals using algorithms to monitor, analyze and report the position of a rigid object in space by attaching a transmitter to a putter shaft that is calibrated to a tripod mounted stationary receiver with feed the registered data into a software program without first calibrating their algorithms to an accurate intended target line. These systems generate feedback in the form of graphic reports of the stroke for training and addressing specific stroke flaws for motor learning without the information that the golf club (putter face) is aimed directly at the intended target. Golf pros know that when the putter face is not directly aimed at the intended target then the feedback generated by these systems would be flawed as they (the measured principals) relate to the intended target line. There could be a variance to the intended target line the player is not aware of when receiving feedback from the system. This variance could be significant making the feedback incorrect.

SUMMARY OF THE INVENTION

A putting alignment system includes a lateral imaging alignment guide having a set of indicia, including an upper indicia, a lower indicia, a right indicia, and a left indicia. The set of indicia can be multiple portions of a single QR code or can be two, three, or four separate QR codes. The lateral imaging alignment guide has a generally flat body that is configured to removably connect to a golf club shaft. A club lower distal tip reflector is configured for mounting on a distal tip of a golf club. A lateral imaging apparatus includes an imaging system. The imaging system has a main camera. The main camera captures and records motion of the lateral imaging alignment guide. A secondary alignment system includes a forward receiver sensor. The forward receiver sensor detects orientation of the club lower distal tip reflector when the club lower distal tip reflector is facing the forward receiver sensor.

The lateral imaging alignment guide is formed with a lateral body having a right arm for mounting the right indicia, a left arm for mounting the left indicia, and upper arm for mounting the upper indicia, and a lower arm for mounting the lower indicia. The upper arm has an upper connector formed as an upper loop strap for connecting to the golf club shaft. The lower arm has a lower connector formed as a lower loop strap for connecting to the golf club shaft. The putting alignment system optionally includes an emitter mounted on the secondary alignment system. The emitter emits radiation toward the club lower distal tip reflector. The forward receiver sensor is mounted adjacent to the emitter but does not see the emitter because there is no direct line of sight between the forward receiver sensor and the emitter.

The data from the aligner sensor input is transmitted wirelessly from the secondary alignment system to the lateral imaging apparatus. The putting alignment system has a right leg and a left leg formed on the secondary alignment system. The right leg and the left leg are dimensioned and proportioned to straddle a golf cup to align the forward receiver sensor over the golf cup.

The secondary alignment system also has a receiver sensor antenna and a receiver sensor antenna transmitter. The receiver sensor antenna transmitter sends data to a main camera antenna receiver of a main camera antenna. The main camera antenna is mounted to the lateral imaging apparatus. The imaging system combines data from and aligner sensor input with data from a base sensor input using a trigonometric algorithm to generate xyz data, which is data in three dimensions. The xyz data locates the golf club in a coordinate system.

Figure 1:
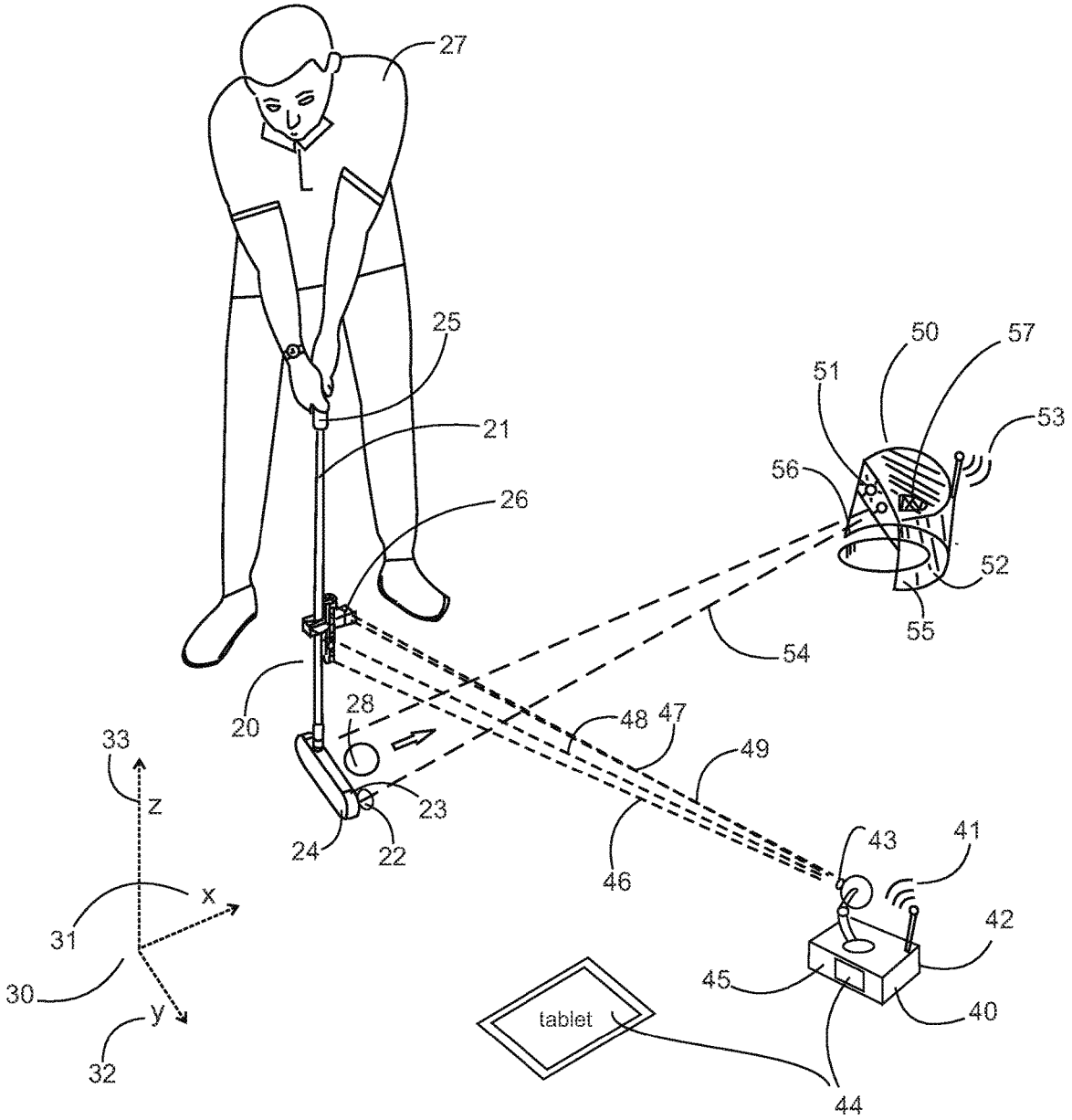
FIG. 1 is a diagram showing the entire system.

The following callout list of elements can be a useful guide in referencing the element numbers of the drawings.

20 club
21 club shaft
22 club lower distal tip reflector
23 club face
24 club lower distal tip
25 grip handle
26 lateral imaging alignment guide
27 golfer
28 golf ball
30 coordinate system
31 x axis
32 y axis
33 z axis
40 lateral imaging apparatus
41 main camera antenna
42 imaging system
43 main camera
44 display screen
45 controls
46 lower vector
47 right vector
48 left vector
50 secondary alignment system
51 emitter
52 forward receiver
53 receiver sensor antenna
54 secondary alignment left beam
55 right leg
56 left leg
57 feed back indicator
61 alignment
62 aligner sensor
63 aligner sensor input
64 aligner memory
65 aligner wireless transceiver
71 swing

72 base sensor
73 base sensor input
74 base transceiver
75 zx plane data
76 trigonometric algorithm
77 xyz data
80 lateral body
81 right arm
82 left arm
83 upper arm
84 lower arm
85 motion sensor
86 upper indicia
87 right indicia
88 left indicia
89 lower indicia
91 upper connector
92 lower connector
93 right bend
94 left bend
95 lateral body plane

DETAILED DESCRIPTION OF THE PREFERRED EMBODIMENT

As seen in FIG. 1, a golfer 27 has a putter and holds a club 20 by a grip handle 25. The club 20 has a club shaft 21. The club 20 has a club face 23. At a club lower distal tip 24, on the club face 23, the golfer 27 mounts a club lower distal tip reflector 22. The golfer also mounts a lateral imaging alignment guide 26 to the club shaft 21. The cover aligns the golfball 28 with the club face 23. When the club alignment is true to the cup, a secondary alignment system 50 provides a feedback indicator 57. The feedback indicator 57 provides an audible or visual indication of alignment. The club face 23 may be parallel to the club shaft 21.

The secondary alignment system 50 has an emitter 51 which can be an infrared emitter. The secondary alignment system 50 has a forward receiver sensor 52 which receives the beam from the emitter 51. The emitter 51 emits light or infrared radiation which bounces from the mirror on the club face 23. The mirror is the club lower distal tip reflector 22. When the forward receiver sensor 52 sees the reflected emitter beam, the forward receiver sensor 52 activates the feedback indicator 57.

The emitter 51 and forward receiver sensor 52 are mounted on a pair of legs, namely a right leg 55 and a left leg 56 so that the right leg 55 and the left leg 56 straddle the cup. The forward receiver sensor 52 is preferably aligned directly over the middle of the cup. The forward receiver sensor 52 is electronically connected to a receiver sensor antenna 53 which can have a Bluetooth or wireless connection with the lateral imaging apparatus 40.

The lateral imaging apparatus 40 receives data regarding the orientation of the club face 23. The lateral imaging apparatus 40 has a main camera antenna 41 connected to a transceiver that connects with the transceiver of the receiver sensor antenna 53. The main camera antenna 41 sends data to the imaging system 42. The main camera 43 images the lateral imaging alignment guide 26 with a right vector 47, a left vector 48, a lower vector 46, and an upper vector 49. The lateral imaging apparatus 40 has a display screen 44, and controls 45. The display screen can display a status of the golfer swing.

By combining the input from the secondary alignment system 50 and the lateral imaging apparatus 40, the location of the club face 23 can be calculated on a coordinate system 30. The coordinate system 30 has an X axis 31, a y-axis 32, and a z-axis 33.

Figure 2:
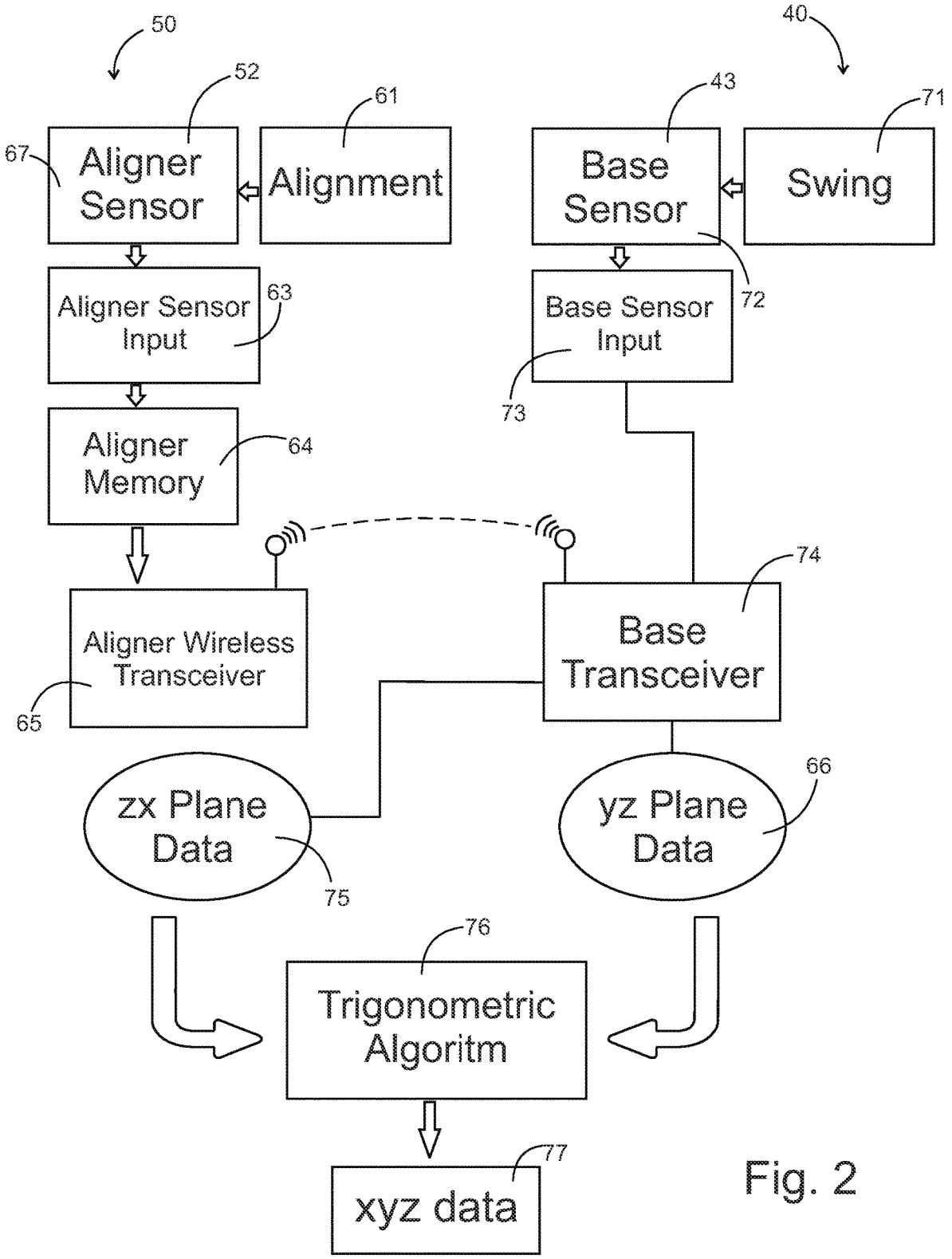
FIG. 2 is a diagram of the software.

As seen in FIG. 2, the present invention first obtains swing data 71 through the main camera 43 interfacing with the lateral imaging alignment guide 26. The base sensor 73 is the main camera 43. The base sensor calculates a base sensor input 73 which is received in a processor that could be mounted on a printed circuit board within the housing of the lateral imaging apparatus 40. The base transceiver 74 receives the YZ plane data 66 which is derived from the orientation of the club face 23. When the emitter 51 bounces a beam off the club lower distal tip reflector 22, which could be formed as a mirror. The rebounding beam aligns to the forward receiver sensor 52 which could be an infrared sensor lodged within a cavity such as a tube.

The alignment data 61 is received by an aligner sensor 62. The aligner sensor input 63 is received into an aligner memory 64. The aligner sensor 62 can be made as the forward receiver sensor 52. When the forward receiver sensor 52 receives a reflection from the club lower distal tip reflector 22, the forward receiver sensor 52 registers existence of club face 23 alignment with the cup. The aligner memory 64 can retain a time function database of aligner sensor input 63. The aligner memory 64 can be transmitted by the aligner wireless transceiver 65 to the base transceiver 74. Then, the lateral imaging apparatus 40 can convert the aligner sensor input 63 to a YZ plane data 66. When YZ plane data 66 input along with the ZX plane data into a trigonometric algorithm 76, the trigonometric algorithm 76 can generate XYZ data 77. The XYZ data 77 can be recorded and played back to the user for improving a golf swing.

Figure 3:
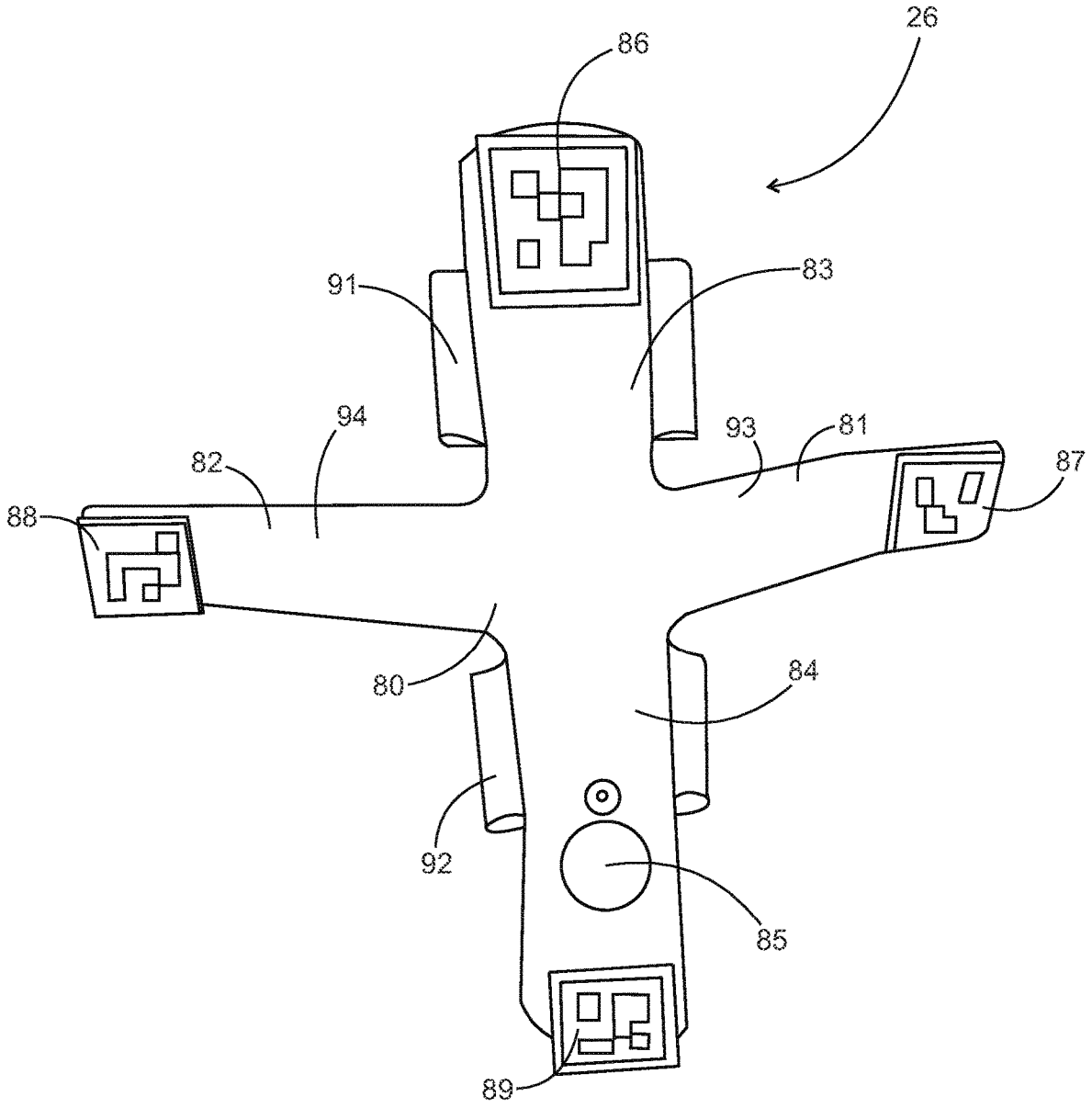
FIG. 3 is a close-up view of the lateral imaging alignment guide.

As seen in FIG. 3, the lateral imaging alignment guide 26 is formed with a lateral body 80 which is a main body of the alignment guide. The lateral body 80 has a right arm 81 extending to the right, and a left arm 82 extending to the left. The right arm anyone has a right bend 93 and the left arm has a left bend 94. The right and left bend may change the plane of the indicia slightly. The lateral body 80 also includes an upper arm 83 and a lower arm 84. The upper arm 83 has an upper indicia 86, and the lower arm 84 has a lower indicia 89. Optionally, a motion sensor 85 can be mounted on the lower arm 84. The lower arm 84 preferably includes a lower connector 92. The lower connector can be formed as a strap or a fabric loop that encircles the shaft of the golf club. Similarly, the upper arm 83 can have an upper connector 91 which can also be a strap or elastic fabric loop such as a hook and loop tape strap. The upper connector 91 also connects to the shaft of a golf club.

The right arm 81 has a right indicia 87, and the left arm 82 has a left indicia 88. The set of indicia which includes the right indicia 87, left indicia 88, upper indicia 86, and the lower indicia 89 can be a QR code format, or other machine-readable icons or symbols. The indicia can be lit with LEDs, fiber-optic passive solar or tritium vials in lowlight. Preferably, the set of indicia are printed in black-and-white for high contrast. The set of extending arms, namely: the right arm 81, the left arm 82, the upper arm 83, and the lower arm 84 are flat and may be flexible. The right bend 93 may bend backwards, and the left bend 94 may also bend backwards so that the right indicia 87 and the left indicia 88 are displayed to the main camera 43 when the main camera 43 is viewing the golfer 27 while the golfer is swinging the club 20. The QR code can be one large QR code where the right indicia 87, the left indicia 88, the upper indicia 86, and the lower indicia 89 are merged into one large single graphic where the software captures the motion of the four corners of the QR code. QR code stands for quick response code and typically has three distinctive squares in three corners to allow alignment. The three distinctive squares can be indicia for alignment. The lack of a distinctive square for alignment in a QR code is also an indicia which allows for the detection of the other three alignment squares in a QR code. The software can use the four indicia to align a single QR code without having four separate QR codes.

Figure 4:
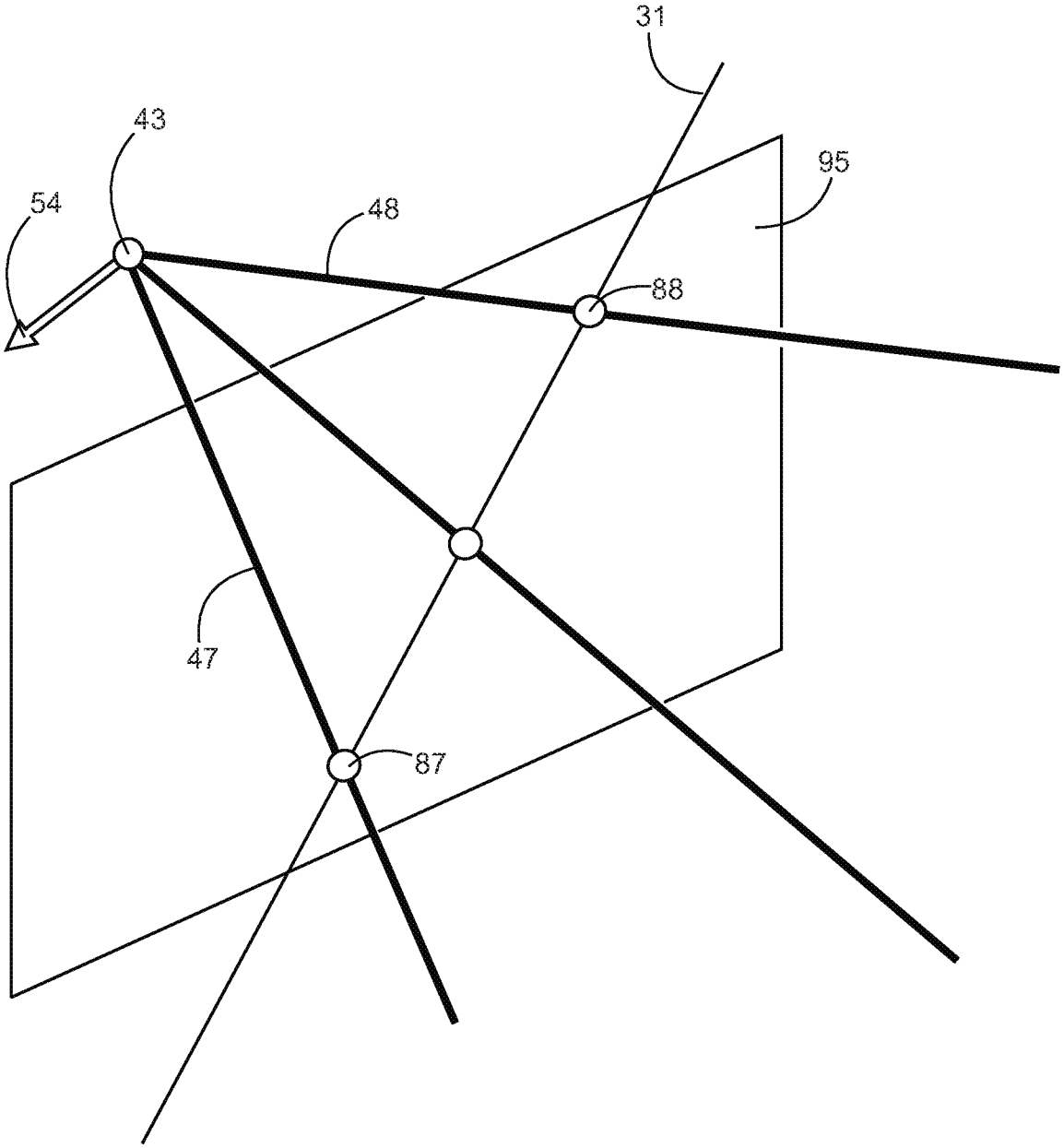
FIG. 4 is a diagram showing calculation of the location of the lateral body plane.

As seen in FIG. 4, for every instantaneous moment, the lateral body plane 95 can be calculated from any of the two or three vectors of the set of vectors, namely: the upper vector 49, the lower vector 46, the right vector 47, and the left vector 48. The lateral body plane 95 is an approximation of the plane that the club shaft 21 is swinging through. The club shaft 21 can be assigned a vector relating to its motion such as the X axis 31 which is the instantaneous moment of the club movement. Although three vectors are typically used for triangulating a lateral body plane 95 using three vectors, the present invention has a fixed lateral imaging alignment guide 26, and thus requires only a pair of vectors. Any indicia in the set of indicia made also have an orientation, however since the orientation indicia is shown relatively short, it would be preferred to use a pair of indicia to find the lateral body plane 95.

The X axis 31 determined from the lateral imaging alignment guide 26 can be compared to the aligner sensor input 63 of the forward receiver sensor 52 to determine a variance between where the golfer is trying to aim, compared to where the golfer is actually aiming. Although the motion capture software analyzes the motion of the lateral imaging alignment guide 26 and approximates a relative alignment at address based on the lateral imaging alignment guide 26 alignment to the camera, this measurement is not vey accurate. Additional data from the forward receiver sensor 52 allows a true alignment at address calculation by also aligning the swing relative to the cup, rather than only relative to the camera. The alignment at impact, and a path at impact calculation can also be improved in the same way.

With a few angular adjustments, the golfer can align the club face 23 to the forward receiver sensor 52 which is over the cup, assuming no break to the left or right. The forward receiver sensor 52 can be positioned according to the topology of the green, which means that in certain situations, the golfer could be aiming to the left or right of the cup or behind the cup.

This ensures that the golfer is putting with a straight clubface due to the feedback indicator 57 which could be an LED light, LED lights, or LCD display to indicate alignment, and optionally a second LED for indicating nonalignment. The straight clubface is largely along the YZ plane. The golfer also provides swing motion data to the imaging system 42 via the lateral imaging alignment guide 26. This provides stroke execution feedback largely along the ZX plane. Using a trigonometric algorithm, the putting alignment system can capture, playback and transmit XYZ data replaying the swing in 3D to the user. The data from the putting alignment system can be transmitted to a golf pro remotely so that the golf pro can give lessons remotely to the golfer, or suggest improvements to the golfer's swing. Optionally, the display screen 44 can display the video camera recording with superimposed swing data from the lateral imaging alignment guide, and the club lower distal tip reflector. The display screen 44 can be implemented on a tablet laptop or other personal device which is separated from the base and wirelessly communicates with the base such as by Wi-Fi, Bluetooth or otherwise.

In a best mode, the putting alignment system determines the intended target line of a rigid object and its target. The putting alignment system provides monitoring, analyzing and reporting the relative displacement of the object based on a predefined location and other movement parameters being analyzed relative to the specified target line originally identified during calibration of the system. The calibration of the system occurs with the secondary alignment system which defines the X axis. When the system is calibrated, the golf club face is facing the golf cup on the green. Therefore, the putting alignment system has two main steps. The first step is to calibrate the system using the club lower distal tip reflector and the secondary alignment system 50. This occurs by moving the clubface or rotating it so as to align the clubface with the infrared receiver on the secondary alignment system 50. The second step is to capture the swing motion now having a target line reference. Combining the calibration of the system with the swing motion capture automatically provides improved data, without manual alignment and calibration. Automated target line alignment and improved data collection allows for remote golf coaching over the Internet and also for do-it-yourself personal improvement.

More particularly, a user first places the lateral imaging apparatus 40 perpendicular to the intended target line and then turns it on. The user then places the aligner which is the secondary alignment system within 25 feet of the base. After the user turns on the secondary alignment system, the user can turn on the laser and infrared beams that emit from the emitter. The emitter can emit a laser which draws a line on the ground to allow visual alignment, and also produce an infrared beam for alignment of the putter face. The infrared beam is parallel to the laser line and approximately one and a half inches apart. The user then attaches a removable reflector to the toe end of the putter face approximately one and a half inches from the center of the putter. The removable reflector can be a self-adhesive sticker. The player stands approximately 18 inches perpendicular to the base with the four markers on the lateral imaging alignment guide 26. The lateral imaging alignment guide can be clipped to the shaft rather than strapped to the shaft. The four indicia are formed as markers and the markers are facing the main camera 43 in the base of the lateral imaging apparatus 40. The player is now ready to calibrate the system to the intended target line.

Calibrating the system to the intended target line occurs in a calibration mode that the user can activate through a mobile device that is wirelessly connected to the base. The imaging system 42 has a calibration mode and an operation mode. In calibration mode, the user moves the putter face so that the infrared sensor detects the reflected infrared beam. The infrared sensor can detect the presence of both a moving and stationary object. Within microseconds of the sensor detecting the presence of the reflected infrared beam, a wireless Bluetooth signal is transmitted from the secondary alignment system 50 to the lateral imaging apparatus 40. For example, a small processor such as a Raspberry Pi can provide a transceiver function. The computer can process the motion capture of the main camera 43 and compare it with the Bluetooth signal. This provides the system with an exact reference point of where the marker is in space relative to the putter face and its orientation to the intended target line. Now, the system is calibrated and ready to properly analyze the putting stroke relative to the intended target line. The base also has a Wi-Fi or Bluetooth module and placed on a gimbal with the camera on the gimbal. The gimbal can have two axis or three axis movement.

Variance to the left or right of the intended target line is negligible. Because the secondary alignment system, the computer having a microchip, and the main camera can identify the location of the markers in space within 2-3 microseconds, the variance of the putter face direction relative to the intended target line is zero for all practical purposes.

In a best mode, the base, which is the lateral imaging apparatus 40 has an on-off switch, a camera, a processor such as a Raspberry Pi model 4 with 4-8 gigabytes of RAM. The base also has a Bluetooth and Wi-Fi module and a gimbal or leveler which has pan tilt multi-servo control for automatic leveling. Additionally, the base preferably includes a rechargeable lithium battery with a built-in USB port that can be charged through a detachable AC/DC power cord that has a USB plug.

The aligner, also called the secondary alignment system 50 has an on-off switch, and preferably an FDA complaint high-powered solid green surveying leveling and alignment laser with an external USB port. The aligner also has an RIR, which is a reflective infrared presence, proximity or motion detector with self programming detection within a specific range. The aligner also preferably has a 3.7 V rechargeable lithium battery with a built-in USB port. The aligner may have a P-NUCLEO-WB55 which is a multi-protocol wireless and ultra-low-power device embedding a powerful and ultra-low-power radio compliant with the Bluetooth® Low Energy (BLE) SIG specification v5.0 and with IEEE 802.15. The USB dongle may support Arduino Uno V3 and ST morpho conductivity.

The invention claimed is:

1. A putting alignment system comprising:

a. a lateral imaging alignment guide having a set of indicia;

b. a club lower distal tip reflector, wherein the club lower distal tip reflector is configured for mounting on a distal tip of a golf club;

c. a lateral imaging apparatus including an imaging system, wherein the imaging system has a main camera, wherein the main camera captures and records motion of the lateral imaging alignment guide; and d. a secondary alignment system, wherein the secondary alignment system includes a forward receiver sensor, wherein the forward receiver sensor detects orientation of the club lower distal tip reflector when the club lower distal tip reflector is facing the forward receiver sensor.

2. The putting alignment system of claim 1, wherein the lateral imaging alignment guide is formed with a lateral body having a right arm for mounting the right indicia, a left arm for mounting the left indicia, and upper arm for mounting the upper indicia, and a lower arm for mounting the lower indicia.

3. The putting alignment system of claim 1, wherein the upper arm has an upper connector formed as an upper loop strap for connecting to the golf club shaft, wherein the lower arm has a lower connector formed as a lower loop strap for connecting to the golf club shaft.

4. The putting alignment system of claim 1, further including an emitter mounted on the secondary alignment system, wherein the emitter emits radiation toward the club lower distal tip reflector, wherein the forward receiver sensor is mounted adjacent to the emitter but does not see the emitter there is no direct line of sight between the forward receiver sensor and the emitter.

5. The putting alignment system of claim 1, wherein the data from the aligner sensor input is transmitted wirelessly from the secondary alignment system to the lateral imaging apparatus.

6. The putting alignment system of claim 1, further including a right leg and a left leg formed on the secondary alignment system, wherein the right leg and the left leg are dimensioned and proportioned to straddle a golf cup to align the forward receiver sensor over the golf cup.

7. The putting alignment system of claim 1, wherein the secondary alignment system further includes a receiver sensor antenna and a receiver sensor antenna transmitter, wherein the receiver sensor antenna transmitter sends data to a main camera antenna receiver of a main camera antenna, wherein the main camera antenna is mounted to the lateral imaging apparatus.

8. The putting alignment system of claim 1, wherein the imaging system combines data from and aligner sensor input with data from a base sensor input using a mathematical algorithm to generate xyz data, wherein the xyz data locates the golf club in a coordinate system.

9. The putting alignment system of claim 8, wherein the lateral imaging alignment guide is formed with a lateral body having a right arm for mounting the right indicia, a left arm for mounting the left indicia, and upper arm for mounting the upper indicia, and a lower arm for mounting the lower indicia.

10. The putting alignment system of claim 8, wherein the upper arm has an upper connector formed as an upper loop strap for connecting to the golf club shaft, wherein the lower arm has a lower connector formed as a lower loop strap for connecting to the golf club shaft.

11. The putting alignment system of claim 8, further including an emitter mounted on the secondary alignment system, wherein the emitter emits radiation toward the club lower distal tip reflector, wherein the forward receiver sensor is mounted adjacent to the emitter but does not see the emitter there is no direct line of sight between the forward receiver sensor and the emitter.

12. The putting alignment system of claim 11, wherein the data from the aligner sensor input is transmitted wirelessly from the secondary alignment system to the lateral imaging apparatus.

13. The putting alignment system of claim 8, further including a right leg and a left leg formed on the secondary alignment system, wherein the right leg and the left leg are dimensioned and proportioned to straddle a golf cup to align the forward receiver sensor over the golf cup.

14. The putting alignment system of claim 8, wherein the secondary alignment system further includes a receiver sensor antenna and a receiver sensor antenna transmitter, wherein the receiver sensor antenna transmitter sends data to a main camera antenna receiver of a main camera antenna, wherein the main camera antenna is mounted to the lateral imaging apparatus.

15. The putting alignment system of claim 1, further including an upper indicia, a lower indicia, a right indicia, and a left indicia, wherein the lateral imaging alignment guide has a generally flat body that is configured to removably connect to a golf club shaft.

16. The putting alignment system of claim 15, wherein the lateral imaging alignment guide is formed with a lateral body having a right arm for mounting the right indicia, a left arm for mounting the left indicia, and upper arm for mounting the upper indicia, and a lower arm for mounting the lower indicia.

17. The putting alignment system of claim 15, wherein the upper arm has an upper connector formed as an upper loop strap for connecting to the golf club shaft, wherein the lower arm has a lower connector formed as a lower loop strap for connecting to the golf club shaft.

18. The putting alignment system of claim 15, further including an emitter mounted on the secondary alignment system, wherein the emitter emits radiation toward the club lower distal tip reflector, wherein the forward receiver sensor is mounted adjacent to the emitter but does not see the emitter there is no direct line of sight between the forward receiver sensor and the emitter.

19. The putting alignment system of claim 15, further including a right leg and a left leg formed on the secondary alignment system, wherein the right leg and the left leg are dimensioned and proportioned to straddle a golf cup to align the forward receiver sensor over the golf cup.

20. The putting alignment system of claim 15, wherein the secondary alignment system further includes a receiver sensor antenna and a receiver sensor antenna transmitter, wherein the receiver sensor antenna transmitter sends data to a main camera antenna receiver of a main camera antenna, wherein the main camera antenna is mounted to the lateral imaging apparatus.

* * * * *